US006253145B1

(12) United States Patent
Garrard et al.

(10) Patent No.: US 6,253,145 B1
(45) Date of Patent: Jun. 26, 2001

(54) SYNCHRONIZATION OF INTERNAL COMBUSTION ENGINE

(75) Inventors: Michael Robert Garrard, Essex; Ray Charles Marshall, Herts, both of (GB)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/411,736

(22) Filed: Oct. 1, 1999

(30) Foreign Application Priority Data

Oct. 3, 1998 (GB) ..... 9821507

(51) Int. Cl.[7] ..... F02D 41/06; F02D 43/04

(52) U.S. Cl. ..... 701/105; 701/112; 701/113; 123/487; 123/491

(58) Field of Search ..... 701/102, 105, 701/112, 113; 123/480, 487, 491, 406.47, 406.53, 179.5

(56) References Cited

U.S. PATENT DOCUMENTS 5,425,340 6/1995 Petitbon et al. .
5,604,304 * 2/1997 Kokubo et al. ..... 73/117.3
5,613,473 3/1997 Angermaier .

* cited by examiner

*Primary Examiner*—Andrew M. Dolinar
(74) *Attorney, Agent, or Firm*—Mark L. Mollon

(57) ABSTRACT

The present invention relates to the synchronization of an internal combustion, four-stroke engine during engine start-up. The engine comprises a number of cylinders with pistons linked to a crankshaft, means to provide a series of pulses on each cycle of the engine, and an engine management system that includes: a memory; means to determine the engine cycle after the engine is cranked; and means to count thereafter the series of pulses until the engine comes to a stop in order to determine the engine cycle of the engine when subsequently stopped so that data representative of the engine cycle may be stored in the memory. According to one aspect of the invention, the means to determine the engine cycle after the engine is cranked is a means to determine the engine cycle during running of the engine. According to another aspect of the invention, the means to determine the engine cycle after the engine is cranked includes a memory that stores data representative of the engine cycle of the engine before the engine was cranked.

19 Claims, 3 Drawing Sheets

SYNCHRONIZATION OF INTERNAL COMBUSTION ENGINE

TECHNICAL FIELD

The present invention relates to the synchronization of an internal combustion four-stroke engine during engine startup.

BACKGROUND ART

When a fuel injection internal combustion engine is started, it is desirable to supply fuel and, for a gasoline engine, sparks to each cylinder in turn at the correct time in order to optimize performance and engine emissions. There are two common ways of determining the state of the engine cycle, either with a single sensor detecting the rotational position of the camshaft, or with a pair of sensors, one on the camshaft and the other on the crankshaft. The single sensor on the camshaft is relatively expensive, and also has to be timed in order to provide the required accuracy. The alternative approach uses cheaper sensors that do not have to be timed in, but the provision of two sensors adds manufacturing cost.

Ideally, it would be desirable to use just one sensor, which does not need to be timed in: that is, a crankshaft sensor alone. The crankshaft sensor gives an accurate signal according to the angular position of the crankshaft, but in a four-stroke engine cannot unambiguously determine engine cycle. For example, in a four-cylinder engine, the crank signal cannot discriminate between cylinder pairs 1 and 4, or 2 and 3.

Patent documents U.S. Pat. No. 5,425,340 and U.S. Pat. No. 5,613,473 disclose ways of addressing the problem of determining engine cycle when there is just a crankshaft sensor. In both of these disclosures, an engine management system purposely causes a misfire on one or more cylinders. This causes a drop in engine power immediately following the misfire, and a consequent small drop in engine speed, which can be detected from the crankshaft signal. Although this approach is effective in determining engine cycle, the misfiring is noticeable to the driver, who will interpret such misfires upon startup of the engine as an engine fault.

Furthermore, such misfires adversely affect the emissions performance of a motor vehicle engine. Although such misfires during cranking of the engine may not affect rated emissions performance in the case where this performance is measured during steady running of the engine, such misfires will affect the rated performance for stricter regulations including the period from when an engine is first started.

DISCLOSURE OF INVENTION

It is an object of the present invention to provide a more convenient way of synchronizing an internal combustion engine upon startup of the engine. According to the invention, there is provided a four-stoke internal combustion engine, comprising a number of cylinders with pistons linked to a crankshaft, means to provide a series of pulses on each cycle of the engine, and an engine management system that includes: a memory; and means to determine the engine cycle after the engine is cranked; characterized in that the engine management system comprises means to count thereafter the series of pulses until the engine comes to a stop in order to determine the engine cycle of the engine when subsequently stopped so that data representative of the engine cycle may be stored in the memory.

The means to determine the engine cycle after the engine is cranked may include a means to determine the engine cycle during running of the engine, for example, some time after cranking of the engine.

The means to determine the engine cycle after the engine is cranked may also include a memory that stores data representative of the engine cycle of the engine before the engine was cranked.

The means to measure the rotation of the engine may include a sensor that measures the revolution of the crankshaft, said sensor producing as an output the series of pulses on each revolution of the crankshaft.

The memory is preferably a non-volatile memory such as an EEPROM or flash memory, and may optionally be integrated with the engine management system.

The sensor may be arranged to measure directly the rotation of the crankshaft. For example, the crankshaft may have a toothed wheel, the sensor being arranged to detect the passage of said teeth as the crankshaft rotates.

The sensor may be any type of sensor, preferably a non-contact type of sensor such as a Hall Effect sensor or a variable reluctance sensor. A Hall Effect sensor has the benefit of producing an output, even as the speed of the crankshaft reaches zero. Variable reluctance sensors are less expensive but provide an output signal with an amplitude that varies in direct proportion with the crankshaft rotational speed. In this latter case, the means to count the pulses includes predictive means to extrapolate from the falling frequency and amplitude of the pulses the engine cycle for the last pulse.

The predictive means may be an empirically derived algorithm, or a lookup table, constructed according to the measured performance of the sensor arrangement.

It is, therefore, possible to compensate for the variability in pulse amplitude such that the final resting position of the crankshaft may be determined, for example, to an accuracy defined by the number of pulses output per revolution of the crankshaft.

In a preferred embodiment of the invention, the means to count pulses as the engine comes to a stop determines in addition to the engine cycle, the engine angle of the stopped engine, so that data representative of the stopped engine angle may be stored in the memory.

When the engine is started, the engine management system may use the series of pulses, for example pulses output from the crankshaft sensor, and said data stored in the memory, to synchronize fuel delivery to the cylinders. In the case of a direct or indirect injection engine, the synchronization may include timing of fuel injection events. Similarly, for a spark ignition engine, the synchronization may include cylinder spark events. Synchronization may therefore be achieved rapidly upon startup of the engine, so improving engine performance including emissions performance as the engine is started.

Also according to the invention, there is provided a method of synchronizing a four-stoke internal combustion engine, the engine comprising a number of cylinders with pistons linked to a crankshaft, means to provide a series of pulses on each cycle of the engine, and an engine management system that includes: a memory; means to determine the engine cycle after the engine is cranked; and means to count the series of pulses; comprising the steps of:

a) providing a series of pulses on each cycle of the engine;

b) supplying the series of pulses to the engine management system; and c) determining the engine cycle; characterized in that the method comprises the steps of:

d) thereafter counting the series of pulses until the engine comes to a stop in order to determine the engine cycle of the subsequently stopped engine; and then e) storing data representative of the engine cycle of the stopped engine in the memory.

Step c) may involve determining the engine cycle during running of the engine, for example some time after cranking of the engine.

Step c) may also involve storing in memory data representative of the engine cycle of the engine before the engine was cranked.

Optionally, step c) may include determining the engine angle of the stopped engine, in which case step e) will include storing in the memory data representative of the engine angle of the stopped engine.

When the engine is to be subsequently started, the data previously stored in memory may be recalled. Then when the engine is cranked, the engine management system can thereafter track or count the series of pulses in order to keep track of the engine cycle. This permits the fuel delivery to the cylinders to be synchronized according to the recalled data and the output from the means to provide a series of pulses.

Optionally, in the case where the engine is a spark ignition engine, cylinder spark events may be synchronized according to the recalled data and the means to provide the series of pulses.

BRIEF DESCRIPTION OF DRAWINGS

The invention will now be described in further detail by way of example, with reference to the accompanying drawings, in which.

BEST MODE FOR CARRYING OUT THE INVENTION

Figure 1:
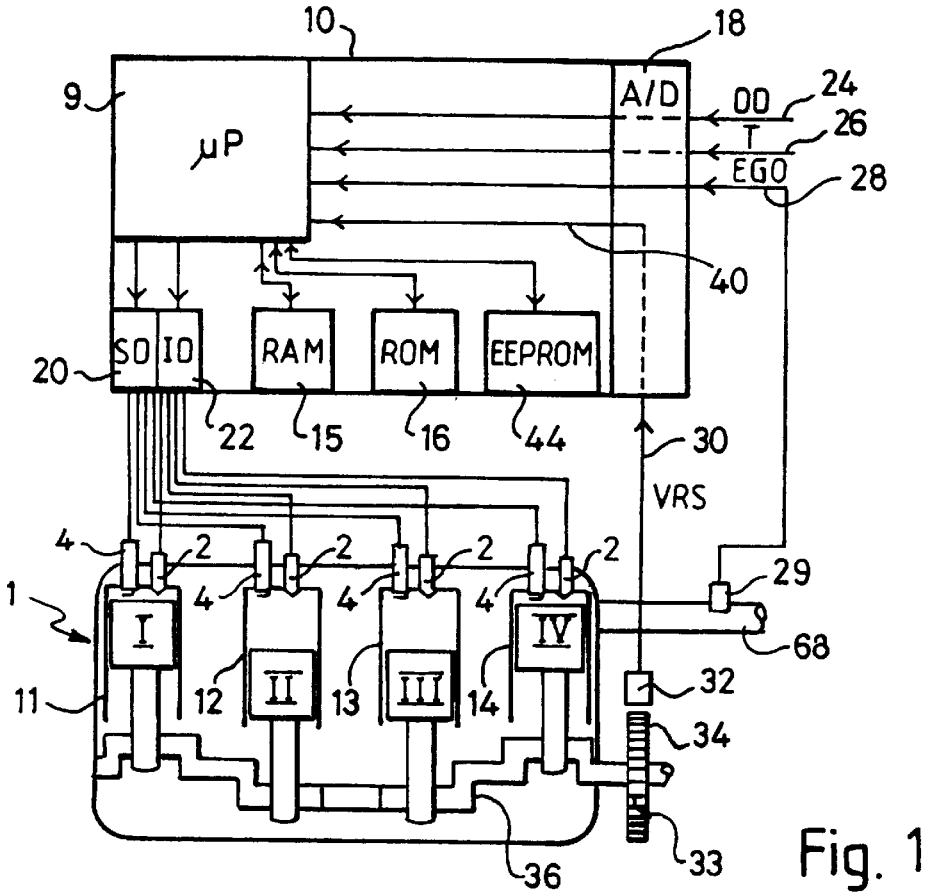
FIG. 1 is a schematic drawing of a four-cylinder, four-stroke internal combustion engine according to the invention, with an engine management system that receives an engine speed signal from a sensor that detects the passage of teeth on a crankshaft flywheel.

FIG. 1 shows schematically a four-cylinder, four-stroke internal combustion engine 1, having a multipoint injection device by which each of four cylinders 11,12,13,14 is supplied with fuel by an electro-injector 2, which may be a direct or an indirect injector. In this example, the engine 1 is a gasoline engine, and so is also equipped with spark plugs 4. The invention is, however, equally applicable to diesel engines, and to engines having a lesser or greater number of cylinders.

The opening sequence and timing of each electro-injector 2 and spark plug 4 is controlled by an electronic engine management system 10, which determines the amount of fuel and timing of fuel and spark events depending on engine operating conditions. This engine control system 10 receives input signals, performs operations and generates output control signals, particularly for the fuel injectors 2 and spark plugs 4. The electronic engine management system 10 conventionally comprises a microprocessor ($\mu$P) 9, a random access memory (RAM) 15, a read only memory (ROM) 16, an analog-to-digital converter (A/D) 18 and various input and output interfaces, including a spark plug driver 20 and an injector driver 22.

The input signals comprise a driver demand signal (DD) 24, an engine temperature signal (T) 26, an exhaust gas oxygen signal (EGO) 28 from an exhaust gas oxygen sensor 29, and a signal 30 from a variable reluctance sensor (VRS) 32, all of which are digitized by the A/D converter 18 prior to being passed to the microprocessor 9.

Figure 2:
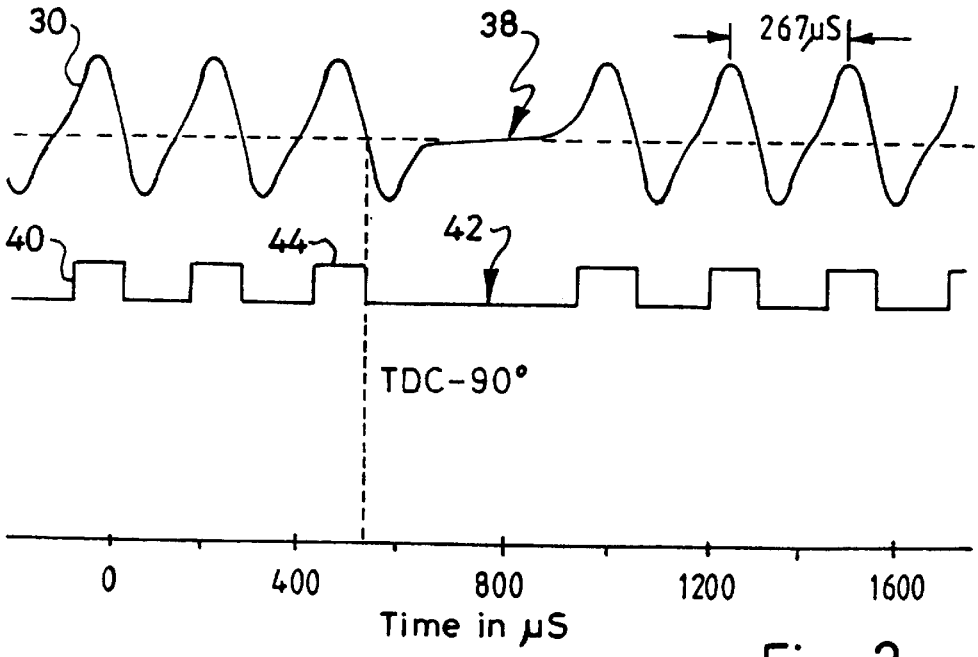
FIG. 2 are plots of the signal from the sensor, before and after digitization by the engine management system.

With reference now also to FIG. 2, which shows the VRS signal 30 for an engine running at 6250 rpm, the variable reluctance sensor 32 senses the passage of teeth 33 spaced circumferentially around the periphery of a flywheel 34 on an engine crankshaft 36. The flywheel 34 has a conventional arrangement of teeth referred to herein as 36-1 teeth, wherein thirty-five identical teeth 33 are equally spaced by thirty-four gaps between teeth, and with a one pair of teeth being spaced by a larger gap three times as large as the other gaps. The larger gap corresponds to one missing tooth. The VRS signal 30 therefore comprises a series of pulses for each revolution of the crankshaft, with one missing pulse, generally indicated at 38 in FIG. 2. Digitization of the raw VRS signal 30 by the A/D converter 18 yields a digitized VRS signal 40, comprising a series of essentially square waves, with one missing pulse 42 corresponding to the missing pulse 38 in the raw VRS signal 30.

The existence of the missing tooth allows the identification of a Top Dead Centre (TDC) position for the engine 1. For example, the falling edge of the last digitized pulse 44 before the missing pulse 42 may be at 90° before TDC. Conventionally, for a four-cylinder, four-stroke engine having four corresponding pistons I,II,III,IV, the TDC position for the engine is also the TDC position of pistons I and IV, during one cycle of the engine, and TDC position of pistons II and III during the next cycle of the engine. FIG. 1 shows pistons I and IV at the top dead centre position.

It should be noted that in the example shown of an in-line, four-cylinder, four-stroke engine, exhibiting a firing order according to the sequence 1-3-4-2, pistons I and IV (or II and III) pass simultaneously to the TDC position, but with different phases from the engine cycle, one then being in the intake (or compression) phase, and the other being in the power (or exhaust) phase. Each piston passes through two cycles, each consisting of 360° of angle, during the four phases or stokes of the cylinder during the intake/compression and power/exhaust phases. The flywheel 34 turns through an angle of 720° during the two cycles, and the variable reluctance sensor 32 produces two pulses indicating a TDC position of the engine 1. It is, therefore, not possible from the VRS signal 30 alone to determine which of the two cycles a cylinder is in, even though the VRS signal gives a good measure of angle after one revolution of the flywheel 34.

Once the engine cycle is known, however, it is in principle possible to keep track of the engine cycle by counting the series of pulses in the VRS signal 30. The term "counting" as used herein includes any means of keeping track of or distinguishing pulses so that the engine management system can discriminate between the two engine cycles. For example, for a four-cylinder engine, the count could cycle repeatedly from one to four, as 1, 2, 3, 4, 1, 2, 3, etc. As will be explained in further detail below, the engine management system 10, therefore, comprises means both to determine the engine cycle during running of the engine, and means to count the series of VRS pulses as the engine comes to a stop in order to determine the engine cycle of the stopped engine. Once the engine is stopped, data representative of the engine cycle, and optionally also the engine angle, are stored in a memory, here a non-volatile, electronically erasable, programmable, read-only memory (EEPROM) 44. When the engine is to be restarted, this data is recalled by the microprocessor 9, which together with the series of VRS pulses 30 as the engine starts to turn, allows the microprocessor to fire the engine with correct scheduling of fuel and spark events according to the sequence 1-3-4-2.

Figure 3:
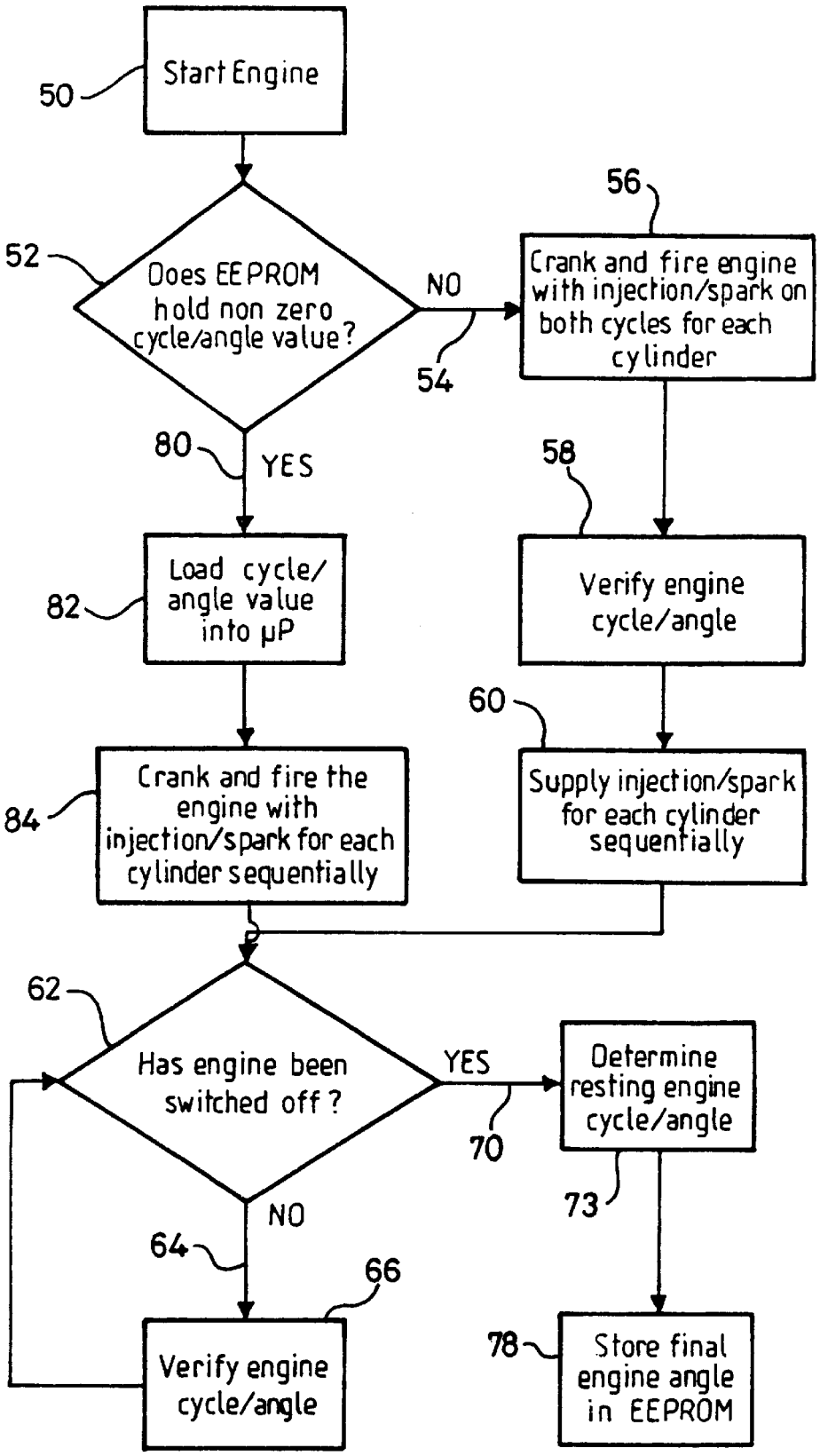
FIG. 3 is a flow diagram describing the control of the engine by the engine management system.

FIG. 3 shows a flow diagram of operation of the engine management system 10 and engine control software running in the microprocessor 9. When an engine is started for the very first time, the engine management system 10 has no record of the engine's resting cycle or angle. This lack of data is represented by a zero value stored in the EEPROM 44. Such a zero value may also be stored in the EEPROM 44 if the engine management system 10, for whatever reason, at some future date was unable to determine the resting cycle of the engine 1.

When the driver turns the ignition key (not illustrated), the microprocessor receives a driver demand signal 24 instructing the microprocessor 9 to begin a sequence of operations 50 to start the engine 1. The microprocessor 9 retrieves data from the EEPROM 44, and tests 52 if this is non-zero. If the data is zero 54, then the microprocessor initiates 56 crank and firing of the engine 1 with fuel injection and spark events scheduled on each cycle of the engine for all cylinders 11–14, so that each cylinder receives two fuel injection commands and two spark events during the two cycles that consist of the four-strokes.

Figure 4A:
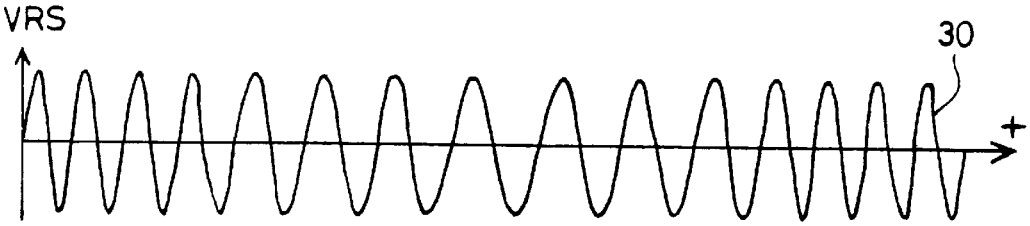
FIGS. 4A and 4B are, respectively, plots of the sensor signal and the crankshaft angular velocity during a misfire of a cylinder.
Figure 4B:
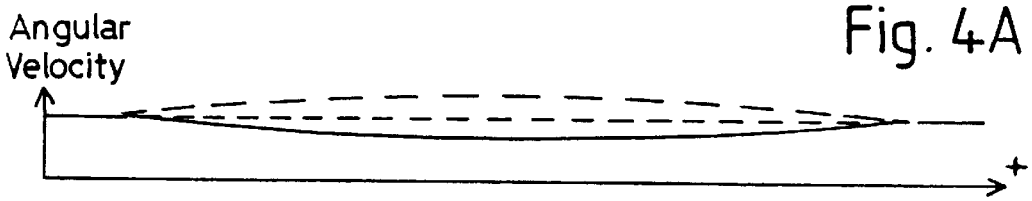

The engine management system 10 then initiates 58 a procedure whereby the engine cycle is determined, so that each cylinder 11–14 can be supplied just once per two cycles with fuel and a spark event at the correct engine angles. The engine cycle may be determined quickly according to the teaching of U.S. Pat. No. 5,425,340 or U.S. Pat. No. 5,613,473, in which fuel is cut to one of the cylinders 11–14. With reference to FIGS. 4A and 4B, this will cause a drop in the expected VRS frequency and crankshaft angular velocity during the power stroke for that particular cylinder.

Once the engine angle is determined, the microprocessor 9 continues to track or count the VRS pulses in order to keep track of the engine cycle. The microprocessor 9 can then supply 60 the cylinders 11–14 with fuel and spark events just once every two engine cycles at the correct engine angles.

The microprocessor tests at intervals if the engine has been switched off 62. If the engine is running 64, then the microprocessor tests 66 the engine to verify that the engine cycle is still correct. Such a test may again be by depriving one cylinder of fuel and measuring the changes in the VRS signal. In general, this will cause noticeable engine roughness. But such verification need not be rapid, since in all likelihood the engine cycle is still correctly known. The engine management system may, therefore, initiate a more subtle but slower test, such as running one cylinder rich and then monitoring the signal 28 from the exhaust gas oxygen (EGO) sensor 29, which is conventionally placed in an engine exhaust conduit 68. EGO sensors have a relatively rapid response time of 50–100 ms. If the cycle for a particular cylinder is correctly known, then the response at the EGO sensor 29 will appear at a time delay of approximately 500 ms after injection for that cylinder, for an engine running at about 1000 rpm. The delay is a sum of delays owing to the time taken during the fuel injection, induction stroke, compression stroke, combustion delay, and transport delay of exhaust gasses in the exhaust conduit 68. If the engine cycle is incorrectly known, then the time delay will be shorter by one cycle, or about 60 ms at an engine speed of 1000 rpm. The microprocessor 9 monitors the correlation between the injection time and the delay in the EGO signal response in order to verify that the cycle is correct. If the cycle is incorrect, then the engine management system 10 switches immediately to the correct cycle, and again monitors the EGO signal to verify that this is correct.

Optionally, this method of synchronizing the engine could be used the first time an engine is started, or whenever the value stored in the EERPROM is zero.

Figure 5A:
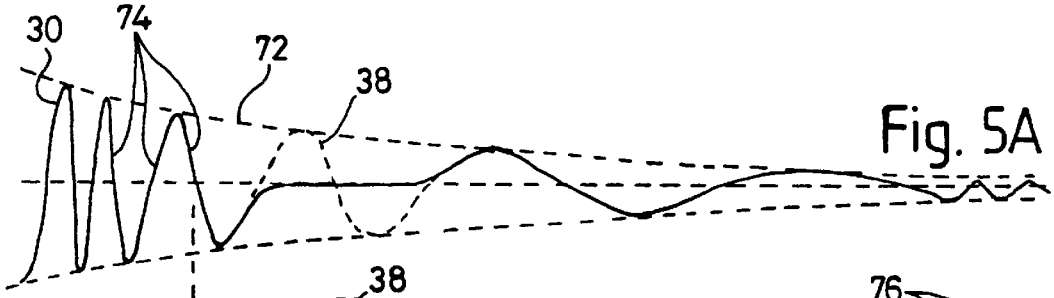
FIG. 5A is a plot of the sensor signal as the engine comes to a stop.
Figure 5B:
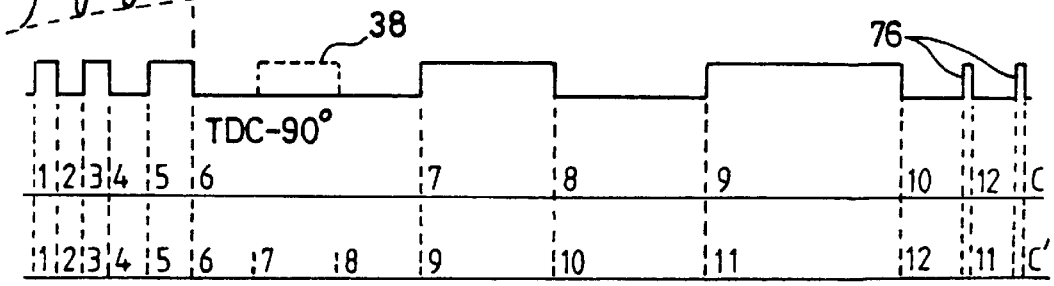
FIG. 5B is a plot of the sensor signal after digitization by the engine management system, and raw and corrected counts of threshold crossing of the digitized signal.

As soon as the engine is switched off 70, the microprocessor 9 immediately starts a final count of VRS pulses 30, as illustrated in FIGS. 5A and 5B. As the engine slows down, the frequency and amplitude of the VRS pulses 30 each decline. The A/D converter 18 has 32 bit resolution and so can distinguish between positive going and negative going sinusoidal VRS pulses between a maximum of ±20 Volts and a minimum of ±0.1 Volts. The microprocessor 9 includes a programmable digital signal processor (not shown) which applies a noise filter with a high frequency cutoff that decreases as the expected VRS amplitude 72 drops, in order to help prevent false triggering as the amplitude of the VRS signal declines.

Digital processing by the microprocessor 9 of the digitised VRS signal 40 allows positive going VRS pulses to be identified and counted 73, as shown in the top row of sequential integers labelled "C" in FIG. 5B. In the example presented, the series of VRS pulses 30 in FIG. 5A includes a missing pulse 38, and so there is no count in C at this location. A feature of the VRS pulses of the slowing engine is that the time between subsequent zero crossings 74 steadily increases, and so software running in the microprocessor can readily determine that pulse 38 is missing. The microprocessor, therefore, corrects the count C, labelled as count C' in FIG. 5B. The final count of C' is then used by the microprocessor 9 to calculate the correct engine cycle and optionally engine angle, which is then stored 78 in the EEPROM memory 44.

Once an engine stops, it is generally the case that there will be some reverse movement of the flywheel 34 as pistons move to equalize forces gasses in cylinders 11–14. Such reverse movement will result in additional pulses 76 which when identified by the microprocessor result in the corrected count C' being decremented. It is, of course, not necessary to identify all such pulses. For example, if an engine flywheel has 36-1 teeth, then as long as the final count C' is accurate to ±17 teeth, the correct engine cycle can be accurately determined as soon as the engine is cranked and the first missing tooth 38 is detected in the VRS signal 30.

As an alternative to detecting individual pulses as the amplitude and frequency drops to zero, the microprocessor 9 could calculate the envelope 72 of the waveform 30, and then either calculate or recall from a lookup table an extrapolated number of counts depending on the rate of decay of the envelope 72.

Returning to consider the rest of FIG. 3, the next time engine is to be started 50, the microprocessor reads 80 a non-zero value in the EEPROM 44, which is then loaded 82 into the microprocessor 9. When the engine is cranked 84 the microprocessor starts to track or count VRS pulses 30 as soon as these appear, in order to keep track of the engine cycle. The stored data is then used together with the VRS pulses 30 to fire the engine with fuel injection and spark events supplied sequentially for each cylinder 11–14 at the correct times during the four strokes of each cylinder. The engine is then operated as described before, with periodic verification 66 of the correct engine cycle and final count of VRS pulses 73 being stored 78 in the EEPROM 44.

Thus, although the initial calibration of engine cycle in step 58 of FIG. 3 may cause a noticeable roughness in the engine, once the engine cycle is known this information is stored for future use whenever the engine is restarted. The initial calibration 58, therefore, does not normally need to be repeated.

The apparatus and method according to the invention thereby permit the engine cycle to be determined in normal operation of the engine without the need to cause intentional misfires of a cylinder, except when an engine is started for the first time.

Compared with systems that need to determine engine cycle each time after starting of the engine, the invention also permits an improvement in emission immediately upon startup of the engine.

Since known engine management systems are typically equipped with microprocessors in order to handle complex computational and control operations, the changes or additions to be made to carry out the described method of synchronization can be attained essentially by changes and additions to the existing microprocessor programs.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A four-stoke internal combustion engine comprising:

a plurality of cylinders with pistons linked to a crankshaft;

a sensor arranged to provide a series of pulses on each cycle of the engine; and an engine management system comprising:

a memory; and a processor arranged to determine the state of the engine cycle after the engine is cranked by counting thereafter the series of pulses until the engine comes to a stop, and storing data representative of the engine cycle in the memory, wherein the amplitude of the series of pulses varies in proportion with rotational speed of the crankshaft, and the processor is programmed to extrapolate from a falling frequency and amplitude of the pulses the state of the engine cycle.

2. A four-stroke internal combustion engine as claimed in claim 1, in which the processor is arranged to determine the engine cycle during running of the engine.

3. A four-stroke internal combustion engine as claimed in claim 1, wherein the processor includes a memory that stores data representative of the engine cycle of the engine before the engine was cranked.

4. A four-stroke internal combustion engine as claimed in claim 3, in which the processor is programmed to use the series of pulses as the engine is started and said data stored in the memory and representative of the engine cycle of the engine before the engine was cranked, to synchronize fuel delivery to the cylinders.

5. A four-stroke internal combustion engine as claimed in claim 4, in which the engine is a spark ignition engine wherein the processor is further programmed to use said data stored in memory and representative of the engine cycle of the engine before the engine was cranked when the engine is started, to synchronize cylinder spark events.

6. A four-stroke internal combustion engine as claimed in claim 1, wherein the sensor is arranged to measure the revolution of the crankshaft, said sensor producing as an output the series of pulses on each revolution of the crankshaft.

7. A four-stoke internal combustion engine as claimed in claim 6, in which the crankshaft has a toothed wheel, the sensor being arranged to detect the passage of said teeth as the crankshaft rotates.

8. A four-stroke internal combustion engine as claimed in claim 1, in which the processor is arranged to determine in addition to the engine cycle, the engine angle of the stopped engine, so that data representative of the stopped engine angle may be stored in the memory.

9. A method of synchronizing a four-stoke internal combustion engine, the engine comprising a plurality of cylinders with pistons linked to a crankshaft, means to provide a series of pulses on each cycle of the engine, and an engine management system that includes: a memory; means to determine the state of the engine cycle after the engine is cranked; and means to count the series of pulses; wherein the method comprises:

a) providing a series of pulses on each cycle of the engine;

b) supplying the series of pulses to the engine management system; and c) determining the engine cycle;

d) thereafter counting the series of pulses until the engine comes to a stop in order to determine the engine cycle of the subsequently stopped engine; and e) storing data representative of the engine cycle of the stopped engine in the memory, wherein the amplitude of the series of pulses varies in proportion with rotational speed of the crankshaft, and the method further comprises extrapolating from a falling frequency and amplitude of the pulses the state of the engine cycle.

10. A method of synchronizing a four-stroke internal combustion engine as claimed in claim 9, in which step c) involves determining the engine cycle during running of the engine.

11. A method of synchronizing a four-stroke internal combustion engine as claimed in claim 9, in which the step c) involves storing in memory data representative of the engine cycle of the engine before the engine was cranked.

12. A method of synchronizing a four-stoke internal combustion engine as claimed in claim 11, in which the method comprises:

f) recalling from the memory said data representative of the engine cycle of the engine before the engine was cranked;

g) cranking the engine; and then h) using the series of pulses as the engine is started and said recalled data representative of the engine cycle of the engine before the engine was cranked to synchronize fuel delivery to the cylinders.

13. A method of synchronizing a four-stoke internal combustion engine as claimed in claim 12, in which the engine is a spark ignition engine and wherein step h) includes using the series of pulses as the engine is started and said recalled data representative of the engine cycle of the engine before the engine was cranked, also to synchronize cylinder spark events.

14. A method of synchronizing a four-stroke internal combustion engine as claimed in claim 9, in which step c) includes determining the engine angle of the stopped engine and step e) includes storing in the memory data representative of the engine angle of the stopped engine.

15. A four-stoke internal combustion engine, comprising a number of cylinders with pistons linked to a crankshaft, means to provide a series of pulses on each cycle of the engine, and an engine management system that includes:

a memory; and means to determine the state of the engine cycle after the engine is cranked, wherein the engine management system is arranged to count thereafter the series of pulses until the engine comes to a stop in order to determine the engine cycle of the engine when subsequently stopped so that data representative of the engine cycle may be stored in the memory, wherein an amplitude of the series of pulses varies in proportion with rotational speed of the crankshaft, and the engine management system is arranged to extrapolate from a falling frequency and amplitude of the pulses the state of the engine cycle.

16. A four-stroke internal combustion engine as claimed in claim 15, in which the means to determine the engine cycle after the engine is cranked is a means to determine the engine cycle during running of the engine.

17. A four-stroke internal combustion engine as claimed in claim 15, in which the means to determine the engine cycle after the engine is cranked includes a memory that stores data representative of the engine cycle of the engine before the engine was cranked.

18. A four-stroke internal combustion engine as claimed in claim 17, in which the engine management system uses the series of pulses as the engine is started and said data stored in the memory and representative of the engine cycle of the engine before the engine was cranked, to synchronize fuel delivery to the cylinders.

19. A four-stroke internal combustion engine as claimed in claim 18, in which the engine is a spark ignition engine wherein the engine management system uses said data stored in memory and representative of the engine cycle of the engine before the engine was cranked when the engine is started, also to synchronize cylinder spark events.

* * * * *